US006345573B1

(12) United States Patent
Motoe et al.

(10) Patent No.: US 6,345,573 B1
(45) Date of Patent: Feb. 12, 2002

(54) MULTI-DRUM ROTARY STENCIL PRINTER WITH EACH SELECTED PRINTING DRUM ISOLATABLE FROM ROTATION

(75) Inventors: Katsuro Motoe; Mitsuru Takeno; Masakazu Miyata, all of Inashiki-gun (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/667,245

(22) Filed: Sep. 22, 2000

(30) Foreign Application Priority Data

Oct. 21, 1999 (JP) ..... 11-299541

(51) Int. Cl.[7] ..... B41L 13/04; B41F 15/04
(52) U.S. Cl. ..... 101/116; 101/115; 101/120
(58) Field of Search ..... 101/115, 116, 101/117, 118, 119, 120, 129, 114

(56) References Cited

U.S. PATENT DOCUMENTS 4,103,615 A * 8/1978 Cruz et al. ..... 101/120
4,911,069 A 3/1990 Hayama et al. ..... 101/120
5,513,565 A * 5/1996 Hasegawa ..... 101/116
5,601,019 A 2/1997 Ohinata et al. ..... 101/129
5,603,260 A * 2/1997 Ohinata et al. ..... 101/129
5,619,918 A * 4/1997 Negishi et al. ..... 101/120

FOREIGN PATENT DOCUMENTS

| | | |
|---|---|---|
| EP | 0 654 359 A2 | 5/1995 |
| EP | 0 897 807 A1 | 2/1999 |
| JP | 7-179014 | 7/1995 |

* cited by examiner

*Primary Examiner*—Leslie J. Grohusky
(74) *Attorney, Agent, or Firm*—Oliff & Berridge, PLC

(57) ABSTRACT

In the multi-drum type rotary stencil printer adapted to drive a plurality of printing drums altogether in synchronization with one another by a common drive mechanism, when one of the printing drums is placed out of engagement with a printing, a degradation of ink is anticipated in the temporarily rested printing drum due to its excessive stirring during an idling rotation. In order to avoid such an ink degradation, a clutch is incorporated in a route of transmitting a driving force from the common drive mechanism to each of the printing drums, so that the transmission of the driving force through each of the route can be selectively interrupted.

4 Claims, 2 Drawing Sheets

MULTI-DRUM ROTARY STENCIL PRINTER WITH EACH SELECTED PRINTING DRUM ISOLATABLE FROM ROTATION

BACKGROUND OF THE INVENTION

1. Field of the Invention

The present invention relates to a stencil printer, and more particularly, to a multi-drum type stencil printer equipped with a plurality of printing drums.

2. Description of the Prior Art

As it gets more popular to produce multi-color overlaid prints by the stencil printing, various sorts of multi-drum type rotary stencil printers equipped with a plurality of printing drums have been tried to make it possible to produce multi-color stencil prints by one printer. In the overlaid prints it is necessary that a plurality of different printings are successively carried out by exactly maintaining the relative position between the respective prints. Because of this requirement, in many of such multi-drum type rotary stencil printers equipped with a plurality of printing drums, a basic construction is such that the plurality of printing drums are rotationally driven around respective central axes by common drive means in synchronization with one another.

On the other hand, each printing drum of the multi-drum type rotary stencil printers incorporates therein an inner press roller contacting the perforated circumferential wall thereof at the inside thereof so as to support the perforated circumferential wall at its inside, while supplying ink to the perforated circumferential wall from the inside thereof, and a doctor rod arranged close to the inner press roller in parallel thereto, so as to define an ink depositing groove together with an outer circumferential surface of the inner press roller, the ink depositing groove having a wedge-shaped cross section for holding an ink deposit therein. Further, in such a construction, the inner press roller is often adapted to be rotationally driven in synchronization with the printing drum by a transmission of rotation of the printing drum thereto via rotation transmitting means such as gear wheels.

When a plurality of printing drums having the above-mentioned basic construction are driven by the common driving means, it is convenient that a plurality of gear trains are arranged so as to mesh respectively with a common drive member such as a gear wheel, and the respective printing drums are driven by the respective gear trains. By such an arrangement, the plurality of printing drums can be driven by the common driving means in synchronization with one another.

When a multi-drum type rotary stencil printer of the above-mentioned basic construction is operated so as to produce prints each bearing overlaid prints supplied thereon by the operation of all of the plurality of printing drums, in each of the printing drums the ink of the ink deposit is successively consumed according to the progress of printing. However, if one of the printing drums is not operated while other one or more of the printing drums are operated, since the ink of the ink deposit of the non-operated printing drum is also drawn out from the ink deposit as carried on the surface of the inner press roller according to the rotation thereof due to a synchronized idling rotation of the non-operated printing drum, with the drawn out ink being returned to the ink deposit without being transferred to the print sheets, it soon occurs that the ink of the ink deposit is too much stirred and causes an undesirable change of its quality.

SUMMARY OF THE INVENTION

In contemplation of such a problem of undesirable change of quality of the ink anticipated in the multi-drum type rotary stencil printers of the above-mentioned basic construction, it is an object of the present invention to provide a multi-drum type rotary stencil printer improved so as to avoid such a problem.

According to the present invention, the above-mentioned object is accomplished by a multi-drum type rotary stencil printer comprising a plurality of printing drums each having a perforated circumferential wall and incorporating therein an inner press roller contacting the perforated circumferential wall at the inside thereof so as to support the perforated circumferential wall from the inside thereof, while supplying ink to the perforated circumferential wall from the inside thereof, and a doctor rod arranged adjacent the inner press roller in parallel thereto so as to define an ink depositing groove together with an outer circumferential surface of the inner press roller, the ink depositing groove having a wedge-shaped cross section for holding an ink deposit, the inner press roller being adapted to rotate in synchronization with the printing drum by a transmittance of rotation of the printing drum via rotation transmitting means, the plurality of printing drums each being adapted to be rotationally driven around each central axis in synchronization with one another by common drive means via each drive linkage, wherein a clutch is provided for selectively interrupting the drive linkage between the common drive means and at least one of the plurality of printing drums.

By such a clutch being incorporated between the common driving means and at least one of the plurality of printing drums which is selectively not operated during the operation of the other printing drum or drums of the multi-drum type rotary stencil printer wherein the plurality of printing drums are adapted to be rotationally driven by the common driving means around the respective central axes in synchronization with one another, the one printing drum is held not to rotate in the meantime by the clutch, so that the inner press roller of the one printing drum is not idly rotated, whereby any excessive stirring of the ink deposit in the wedge-shaped ink depositing groove formed between the inner press roller and the doctor rod is avoided.

In the multi-drum type rotary stencil printer of the above-mentioned construction, the common drive means may comprise a first gear wheel adapted to rotate integrally with the press roller, while each of the printing drums may comprise a second gear wheel adapted to rotate integrally therewith, and the drive linkage for each of the printing drums may comprise a gear train including a third gear wheel meshing with the first gear wheel and a fourth gear wheel meshing with the second gear wheel, the clutch being incorporated between the third and fourth gear wheels. By such an arrangement, the drive linkage for each of the printing drums is available in a compact construction requiring only one additional axis for rotary members.

In the above-mentioned construction of the drive linkage, the drive linkage may comprise a planetary gear mechanism having a ring gear adapted to rotate integrally with the third gear wheel, a sun gear adapted to rotate coaxially with the fourth gear wheel, a carrier and a plurality of planetary pinions supported by the carrier to be rotatable about respective axes thereof and meshing with the ring gear and the sun gear, the carrier rotatably supporting the planetary pinions being finely adjustable of its angular position around a coinciding central axis of the ring gear and the sun gear, with the clutch being incorporated between the sun gear and the fourth gear wheel. By such an arrangement, the rotational position of each of the printing drums relative to the press roller can be finely adjusted for a fine adjustment of the longitudinal position of the print image produced by each of the printing drums on a print sheet, as required for the overlaid printing by the plurality of printing drums.

In the above-mentioned construction of the drive linkage, the clutch may comprise a spline bore formed in a hub of the sun gear, a spline shaft axially slidably engaged in a spline bore formed axially through the fourth gear wheel and selectively engageable in the spline bore of the sun gear, and means for selectively shifting the spline shaft in an axial direction thereof so that the spline shaft is engaged into or disengaged from the spline bore of the sun gear. By such an arrangement, the clutch is conveniently incorporated in the one additional axis for the rotary members.

Further, the second gear wheel may be provided as a pair arranged at opposite axial ends of the printing drum, while the fourth gear wheel may also be provided as a pair to mesh with the pair of second gear wheels, the drive linkage further comprising a hollow shaft connecting the pair of fourth gear wheels integrally with one another, with an axial extension of the spline shaft being passed through the hollow shaft so as to be operated at an end thereof remote from the spline bore of the third gear wheel for the selective engagement therewith. By such an arrangement, the printing drum is rotationally driven from the common driving means via the drive linkage with no twisting being applied thereto.

BRIEF DESCRIPTION OF THE DRAWINGS

In the accompanying drawings.

DESCRIPTION OF THE PREFERRED EMBODIMENTS

Figure 1:
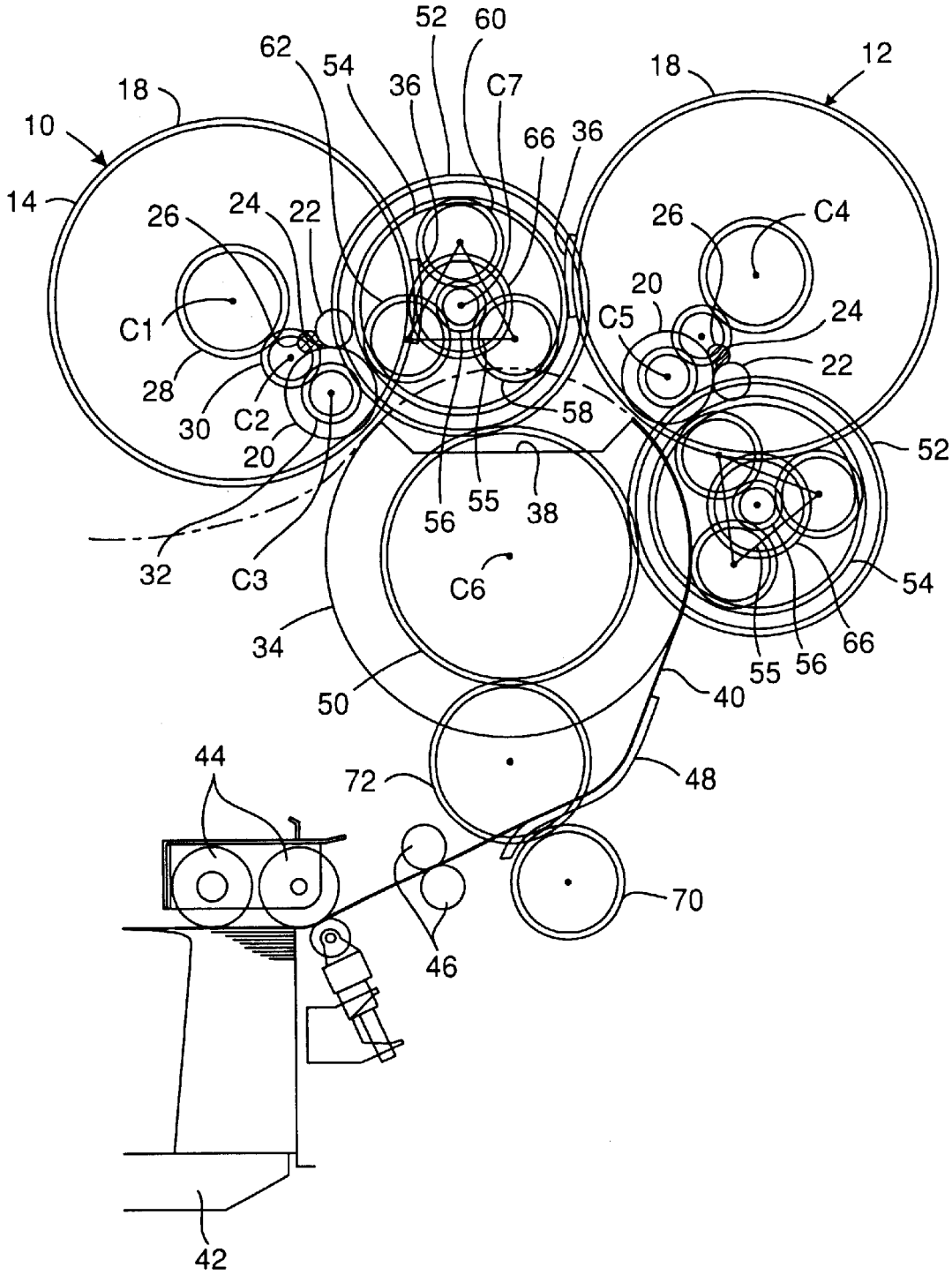
FIG. 1 is a diagrammatical illustration of an embodiment of the multi-drum type rotary stencil printer according to the present invention with respect to its basic construction.

Referring to these figures, 10 is a printing drum, and 12 is another printing drum. The printing drum 12 has a substantially same construction as the printing drum 10.

The printing drum 10 has a pair of gear wheels 14 and 16 connected with one another by a frame of the printing drum not shown in the figure, a perforated cylindrical circumferential wall 18 extending between the pair of gear wheels 14 and 16, an inner press roller 20 arranged at the inside of the circumferential wall 18 so as to contact it at the inside thereof, while supplying ink to the inside thereof, and a doctor rod 22 arranged close to the inner press roller in parallel thereto, wherein an ink depositing groove 24 having a wedge-shaped cross section is formed between the inner press roller 20 and the doctor rod 22 for holding an ink deposit 26. The ink deposit 26 is appropriately supplemented with ink by ink supply means not shown in the figure according to a consumption thereof due to a progress of printing. The ink supply means of this kind are well known in the art. The provision of the inner press roller 20, the doctor rod 22 and the ink depositing groove 24 and the state of forming the ink deposit 26 are the same with respect to the printing drum 12. Therefore, those constructions in the printing drum 12 are indicated by the same reference numerals as in the printing drum 10.

The printing drum 10 is equipped with a gear wheel 28 adapted to rotate integrally therewith around its central axis C1. The gear wheel 28 is meshed with a gear wheel 30 supported by a frame not shown in the figure so as to rotate around its central axis C2. The gear wheel 30 is meshed with a gear wheel 32 adapted to rotate integrally with the inner press roller 20 around its central axis C3. By means of such a gear train, when the printing drum 10 is rotated around the central axis C1, the inner press roller 20 is rotated around the central axis C3 in the same rotational direction as the printing drum 10. The same gear wheels 28, 30 and 32 are provided for the printing drum 12, so that when the printing drum 12 is rotated around its central axis C4, the inner press roller 20 thereof is rotated around its central axis C5 in the same direction as the printing drum 12.

34 is a press roller which has a substantially same diameter as the printing drums 10 and 12 and is supported by a frame of the printer not shown in the figure so as to rotate around its central axis C6. The outer circumferential surface of the press roller 34 is slightly removed from the perforated circumferential wall 18 of the printing drums 10 and 12 as diagrammatically shown in FIG. 1.

The printing drums 10 and 11 are each equipped with a transverse bar 36 extending at a portion of the outer circumferential surface thereof along a generatrix of its cylindrical shape. The transverse bar 36 is adapted to hold a leading end of a stencil sheet to be mounted around the circumferential wall of the printing drum. On the other hand, the press roller 34 is formed with a transverse groove 38 at a portion of its outer circumferential wall along a generatrix of its cylindrical shape. The transverse groove 38 receives the transverse bars 36 of the printing drums 10 and 12 therein when they move respectively in proximity of the outer circumferential wall of the press roller, so as to avoid a collision therebetween.

To the press roller 34 is attached a leading end, i.e. an upper end in FIG. 1, of a print sheet 40 by a clamp not shown in the figure provided along an edge of the groove 38. The print sheet 40 is supplied from a stack thereof charged in a print sheet supply tray 42 as drawn out by a print sheet drawout roller 44 rotated in synchronization with the printing drum and the press roller, and transferred through a pair of timing rollers 46 and along a guide 48 as shown in the figure.

The press roller 34 is equipped with a gear wheel 50 adapted to rotate integrally therewith around its central axis C6. The gear wheel 50 is meshed with an annular gear wheel 52 supported by the frame of the printer not shown in the figure so as to rotate around its central axis C7. The annular gear wheel 52 is provided with inner gear teeth 54 at its inside. A gear wheel 56 is provided as supported by the frame of the printer not shown in the figure so as to rotate coaxially with the annular gear wheel 52 around the central axis C7. Then, arranging the gear wheel 56 as a sun gear and the inner gear teeth 54 of the annular gear wheel 52 as a ring gear, three gear wheels 58, 60 and 62 supported by a carrier 55 are meshed therewith therebetween as planetary pinions in the construction of a planetary gear mechanism for transmitting the rotation of the annular gear wheel 52 to the gear wheel 56. Although not shown in the figure, the carrier 55 rotatably supporting the gear wheels 58, 60 and 62 is adapted to be finely adjustably rotatable about the central axis C7, so that the rotational position of the printing drum 10 relative to the press roller 34 can be finely adjusted for a fine adjustment of the longitudinal position of the print image produced by the printing drum 10 on the print sheet 40. Such a fine adjustment of the longitudinal position of the print image on the print sheet 40 is required for the overlaid printing by the plurality of printing drums 10 and 12.

Figure 3:
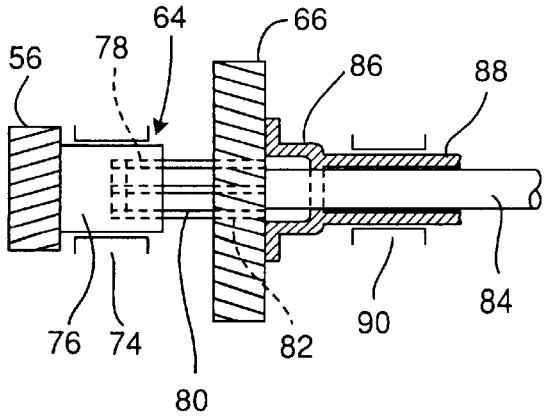
FIG. 3 is a diagrammatical side view showing a detail of the construction of the clutch incorporated in a part of the multi-drum type rotary stencil printer shown in FIGS. 1 and 2.

The gear wheel 56 is drivingly connected with a gear wheel 66 arranged coaxially therewith by a clutch 64 somewhat diagrammatically shown in FIG. 3. The gear wheel 66 is meshed with the gear wheel 14 of the printing drum. Thus, the rotation of the press roller 34 is transmitted through the above-mentioned planetary gear mechanism and the clutch 64, so as to drive the printing drum 10 via the gear wheel 14. The same driving mechanism including such a planetary gear mechanism and such a clutch is provided for the printing drum 12. The members constructing such a drive mechanism for the printing drum 12 corresponding to those for the printing drum 10 are designated by the corresponding reference numerals in FIG. 1. The press roller 34 is rotationally driven by an electric motor 68 via a gear wheel 70 provided at its output shaft and a gear wheel 72 meshing therewith and its own gear wheel 50.

When the printing drums 10 and 12 are rotated by the above-mentioned rotational drive means in synchronization with one another, the ink is transferred through the stencil sheets mounted around the perforated circumferential walls of the printing drums 10 and 12 to the print sheet 40 when the print sheet 40 is positioned between the press roller 34 and the printing drums 12 and 10, respectively, by the inner press roller 20 being shifted radially outwardly relative to each of the printing drums by pertinent driving means not shown in the figure, so that the perforated circumferential wall of each of the printing drums is slightly bulged radially outwardly toward the press roller, while a part of the ink deposit 26 held in the ink depositing groove 24 is carried by the inner press roller 20 as a thin ink layer having a thickness controlled by the doctor rod 22 when the inner press roller 20 rotates, so that the ink of the ink layer is pressed through perforated portions of the stencil sheet to be transferred onto the print sheet.

Figure 2:
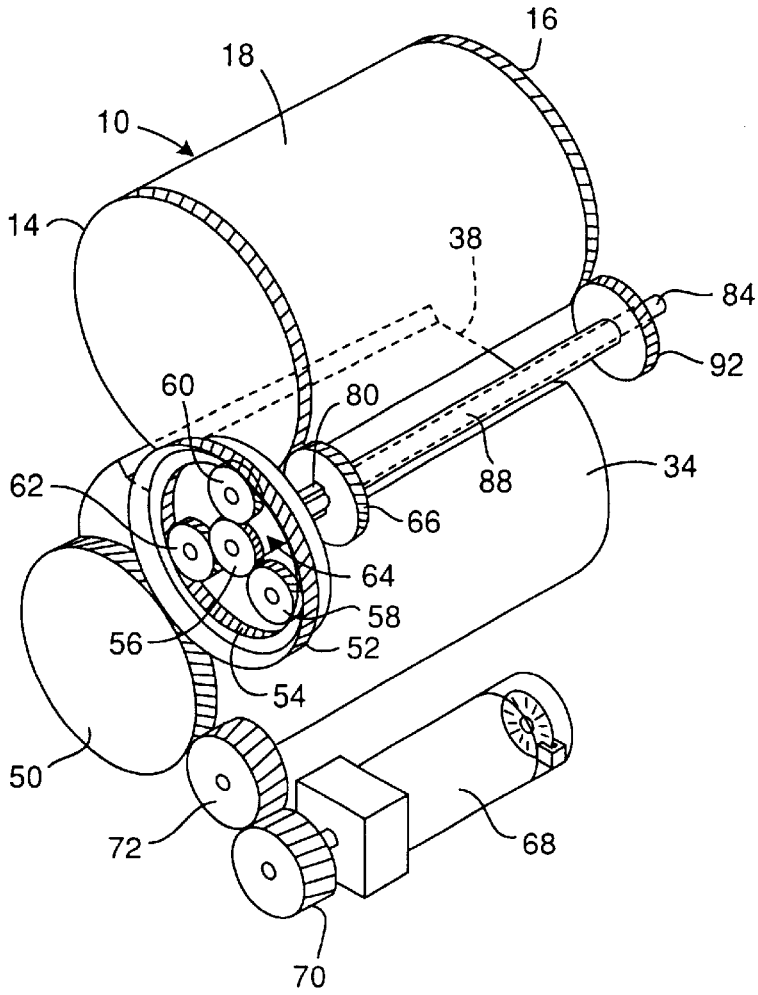
FIG. 2 is a perspective view of the multi-drum type rotary stencil printer shown in FIG. 1 with a portion thereof being removed for the purpose of illustration.

As shown in FIG. 3, the clutch 64 includes a hub 76 rotationally supported by a bearing 74 and supporting in turn the gear wheel 56. The hub 76 is formed with a spline bore 78, into which a spline shaft 80 is engaged. The spline shaft 80 is engaged with a spline bore 82 formed in the gear wheel 66 to be of the same cross sectional shape as the spline bore 78. The spline shaft 80 is integrally connected with a spline control shaft 84. The gear wheel 66 is rotationally supported by a bearing 90 mounted to the frame of the printer not shown in the figure by a hub 86 and a hollow shaft 88 thereof. A gear wheel 92 of the same shape as the gear wheel 66 is mounted to the other end of the hollow shaft 88, so as to mesh with the gear wheel 16 of the printing drum 10. The spline control shaft 84 is passed through the hollow shaft 88 and is selectively moved in its axial direction at its right end in FIG. 2 by a clutch control mechanism not shown in the figure between a position for engaging the tip end of the spline portion into the spline bore 78 of the hub 76 and a position for disengaging the tip end of the spline portion out of the spline bore 78. The clutch mechanism shown in FIG. 3 is incorporated in the same manner between the gear wheels 56 and 66 for the printing drum 12.

Thus, according to the present invention, in the multi-drum type rotary stencil printer having a plurality of printing drums adapted to be rotationally driven in synchronization with one another by the common drive means so as to simultaneously carry out a multi-color overlaid printing, when either one of the printing drums is temporarily placed out of engagement with the multi-color overlaid printing, with the ink deposit being maintained in the ink depositing groove formed between the inner press roller and the doctor rod, the temporarily rested printing drum is temporarily isolated from the transmission of the driving force by the clutch 64, while the shifting of the inner press roller 20 toward the press roller 34 is withheld not to carry out the printing. By the temporarily rested printing drum being stopped from rotation, it is avoided that the ink deposit in the ink depositing groove 24 of the rested printing drum is excessively stirred so as to cause an undesirable degradation of the ink.

Although the present invention has been described in detail with respect to an embodiment thereof, it will be apparent for those skilled in the art that various modifications and other embodiments are possible within the scope of the present invention.

What is claimed is:

1. A multi-drum rotary stencil printer comprising an outside press roller, and a plurality of printing drums arranged outside of the outside press roller, the printing drums each having a perforated circumferential wall and incorporating therein an inner press roller contacting each perforated circumferential wall at the inside thereof so as to support each perforated circumferential wall from the inside thereof, while supplying ink to each perforated circumferential wall from the inside thereof, and a doctor rod arranged adjacent each inner press roller in parallel thereto so as to define an ink depositing groove together with an outer circumferential surface of each inner press roller, each ink depositing groove having a wedge-shaped cross section for holding an ink deposit, each inner press roller being adapted to rotate in synchronization with each printing drum by a transmittance of rotation of each printing drum, and a common drive means, a drive linkage, and a clutch, the plurality of printing drums each being adapted to be rotationally driven around a central axis thereof in synchronization with one another by the common drive means via the drive linkage with incorporation of the clutch provided for selectively interrupting the drive linkage between the common drive means and at least one of the plurality of printing drums, wherein the common drive means comprise a first gear wheel adapted to rotate integrally with the outside press roller, while each of the printing drums comprises a second gear wheel adapted to rotate integrally therewith, and the drive linkage for each of the printing drums comprise a gear train including a third gear wheel meshing with the first gear wheel and a fourth gear wheel meshing with the second gear wheel, the clutch being incorporated between the third and fourth gear wheels.

2. The multi-drum rotary stencil printer according to claim 1, wherein the drive linkage comprise a planetary gear mechanism having a ring gear adapted to rotate integrally with the third gear wheel, a sun gear adapted to rotate coaxially with the fourth gear wheel, a carrier and plurality of planetary pinions supported by the carrier to be rotatable about respective axes thereof and meshing with the ring gear and the sun gear, the carrier rotatably supporting the planetary pinions being finely adjustable in angular position around a coinciding central axis of the ring gear and the sun gear, with the clutch being incorporated between the sun gear and the fourth gear wheel.

3. The multi-drum rotary stencil printer according to claim 2, wherein the sun gear comprises a hub, the fourth gear wheel comprises a spline bore, and the clutch comprises a spline bore formed in the hub of the sun gear, a spline shaft axially slidably engaged in the spline bore formed axially through the fourth gear wheel and selectively engageable in the spline bore of the sun gear, and means for selectively shifting the spline shaft in an axial direction thereof so that the spline shaft is engaged into or disengaged from the spline bore of the sun gear.

4. The multi-drum rotary stencil printer according to claim 3, wherein the second gear wheel is provided as a pair arranged at opposite axial ends of each printing drum, while the fourth gear wheel is also provided as a pair to mesh with the pair of second gear wheels, the drive linkage further comprising a hollow shaft connecting the pair of fourth gear wheels integrally with one another, with an axial extension of the spline shaft being passed through the hollow shaft so as to be operated at an end thereof remote from the spline bore of the fourth gear wheel for the selective engagement therewith.

* * * * *